US006176048B1

(12) United States Patent
Berger

(10) Patent No.: US 6,176,048 B1
(45) Date of Patent: Jan. 23, 2001

(54) WEEP HOLE SCREEN DEVICE AND METHOD

(76) Inventor: Bruce B. Berger, 4601 OSO Pkwy., Corpus Christi, TX (US) 78413

( * ) Notice: Under 35 U.S.C. 154(b), the term of this patent shall be extended for 0 days.

(21) Appl. No.: 09/340,807

(22) Filed: Jun. 28, 1999

(51) Int. Cl.[7] ..... E04B 1/72; E04H 9/16
(52) U.S. Cl. ..... 52/101; 52/302.3; 52/745.2
(58) Field of Search ..... 52/101, 302.1, 52/302.3, 302.7, 741.3, 741.4, 745.2

(56) References Cited

U.S. PATENT DOCUMENTS

D. 372,068 * 7/1996 Disanto ..... D22/119
3,429,084 * 2/1969 Brewer ..... 52/302.1 X
4,102,093 * 7/1978 Harris ..... 52/101
4,587,892 * 5/1986 Witten et al. ..... 52/302.1 X
4,669,371 * 6/1987 Sarazen, Jr. et al. ..... 52/302.1 X
5,203,795 * 4/1993 Balamut et al. ..... 52/302.1
5,274,968 * 1/1994 Pardo ..... 52/302.4 X
5,349,799 * 9/1994 Schiedegger et al. ..... 52/302.1 X
5,870,864 * 2/1999 Snyder et al. ..... 52/302.1 X
6,044,594 * 4/2000 Desselle ..... 52/101

* cited by examiner

*Primary Examiner*—Carl D. Friedman
*Assistant Examiner*—Kevin D. Wilkens

(57) ABSTRACT

A screen device to prevent animal entry into weep holes of foundation walls is formed from flexible, polymeric materials such as nylon or other conventional plastics. The screen device includes a frame having inner and outer sections with a porous barrier therebetween. The method of installing the screen device over a foundation wall weep hole includes the step of sealing the edges of the outer frame section with a standard silicone sealant, and thereafter inserting a porous barrier into the outer frame section. The porous barrier is releasably held in place with an inner frame section which is lastly placed in and connected to the outer frame section.

9 Claims, 6 Drawing Sheets

WEEP HOLE SCREEN DEVICE AND METHOD

FIELD OF THE INVENTION

The invention herein pertains to a device to prevent insects, snakes and other small animals from entering the crawl space of a building, and particularly pertains to a device for preventing such animals from entering the crawl space through weep holes in foundation walls.

BACKGROUND AND OBJECTIVES OF THE INVENTION

Foundation walls for houses and other buildings are often veneered or include brick. To prevent excess moisture build-up, weep holes are formed at specified intervals in the foundation which usually consists of an absence of mortar between the ends of abutting bricks. Thus, should moisture collect in the foundation wall, the weep holes allow some air to circulate and the moisture to be removed. While these weep holes are important for the wall, they also provide a compelling entry for insects, small snakes, lizards and other small undesirable animals. For example, it is not unusual for termites or bees to use a weep hole for entry or nest construction, thus blocking the weep holes and causing harm to the building structure. In southern Texas roaches and large bees cause homeowners problems by nesting and crawling into the weep holes, often multiplying in or closely nearby.

In order to prevent insect entry, it has been known in the past to place screen wire within the weep holes to prevent access. However, by merely plugging the weep hole with screen wire or other porous materials, small insects can infiltrate the plugged weep holes even though passage is somewhat obstructed. If such insects build a nest within the plugged weep hole, air passage is greatly reduced, therefore defeating the original purpose of the weep hole.

With the problems associated with prior attempts at preventing animal entry into the weep holes, the present invention was conceived and one of its objectives is to provide a device to prevent animal entry by the use of a porous barrier positioned over the weep hole.

It is yet another objective of the present invention to provide a porous barrier contained within a flexible frame which can be contoured to the outer wall structure.

It is yet another objective of the present invention to provide a device which includes a flexible frame having inner and outer sections with an easily removable porous barrier sandwiched in between.

Yet still another objective of the present invention is provide a method for preventing animal entry into a weep hole by the use of a porous barrier which is releasably attached for easy cleaning.

Various other objectives and advantages of the present invention will become apparent to those skilled in the art as a more detailed description is set forth below.

SUMMARY OF THE INVENTION

The aforesaid and other objectives are realized by providing a screen device and method which will prevent insects and other small animals from entering crawl spaces or foundation walls through weep holes contained therein. The device includes a porous barrier or screen which may be formed from polyester, nylon or other polymeric materials as are commercially available for use as window screens. The porous barrier is contained within an outer frame and is held in place by an inner frame having tabs to allow it to be releasably, yet tightly secured to the outer frame. Both the outer and inner frames are formed from flexible plastic or polymeric materials such as by molding, stamping or other conventional methods. By the use of flexible polymeric materials, the frame can be easily bent and contoured to the foundation wall which may be rough and uneven. A conventional silicone sealant is applied to the edges of the frame and/or porous barrier to seal the same to the foundation wall around the weep hole. By carefully sealing the frame to the outer surface of the foundation wall, insects such as roaches, bees and the like are then forced to attempt to enter the weep hole through the porous barrier contained therein, which, is sized to prevent such entry. Should the porous barrier become dirty or clogged, the inner frame section can be easily removed and the porous barrier extracted for cleaning purposes where it can then be easily replaced.

DETAILED DESCRIPTION OF THE PREFERRED EMBODIMENT AND OPERATION OF THE INVENTION

Figure 1:
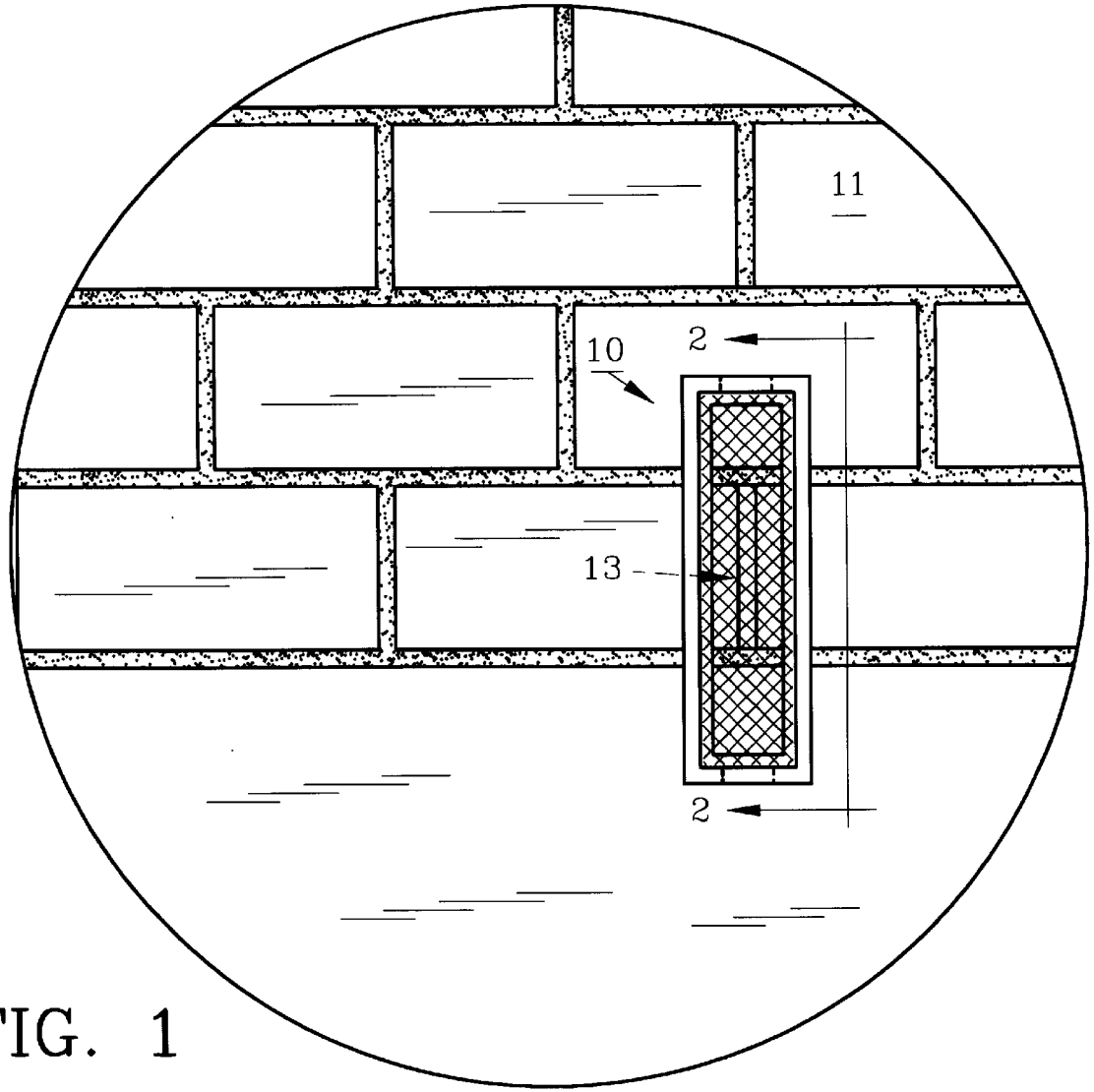
FIG. 1 demonstrates a front elevational view of a building foundation wall section as for a conventional single family dwelling with the weep hole screen device of the invention attached.

For a better understanding of the invention and its method of use, turning now to the drawings, FIG. 1 shows a typical installation of preferred weep hole screen device 10. As seen, weep hole screen device 10 is attached to a brick (upper) and concrete (lower) foundation wall 11 of, for example a conventional single family dwelling (not seen) by first affixing outer frame section 16 to foundation wall 11. Next, porous barrier 15 is placed in the fixed outer frame section 16 and lastly, inner frame section 17 is positioned on porous barrier 15 as inner frame section 17 is connected within outer frame section 16. As would be understood, weep hole screen device 10 is used to cover weep holes 13 of which a plurality are spaced incrementally around the foundation of a conventional house or other structure having a crawl space therebeneath. While not shown in FIG. 1, all foundation wall weep holes 13 would employ screen device 10 to prevent insects and other small animals from access to the crawl space by the use of a porous barrier 15 selected with proper size apertures as illustrated in FIGS. 3 and 9.

Figure 6:
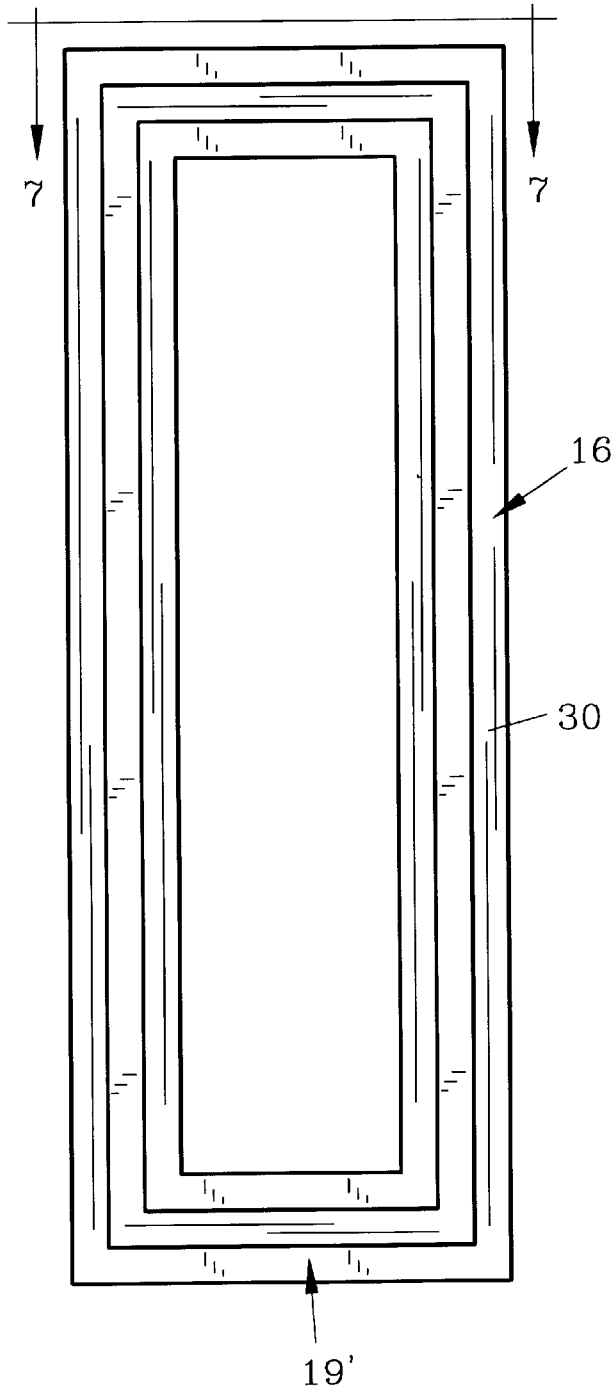
FIG. 6 shows a rear elevational view of the outer frame section with the screen removed and with a tear-away perimeter as may be included.

An optional tear-away perimeter 30 is shown in FIG. 6 which allows a larger base for attachment for outer frame section 16, for very rough or uneven foundation walls. Perimeter 30 can be easily removed from outer frame section 16 by manually tearing as desired.

Figure 3:
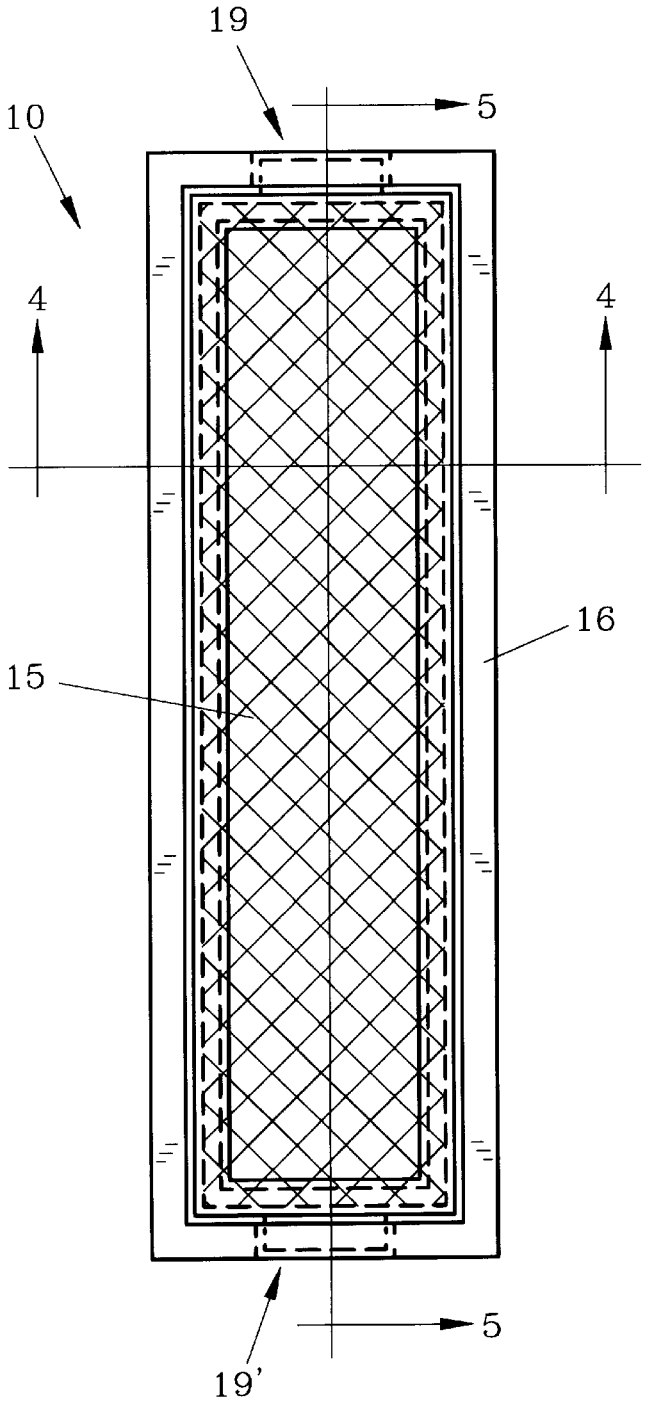
FIG. 3 illustrates an enlarged rear elevational view of the screen device as seen in FIG. 1.
Figure 8:
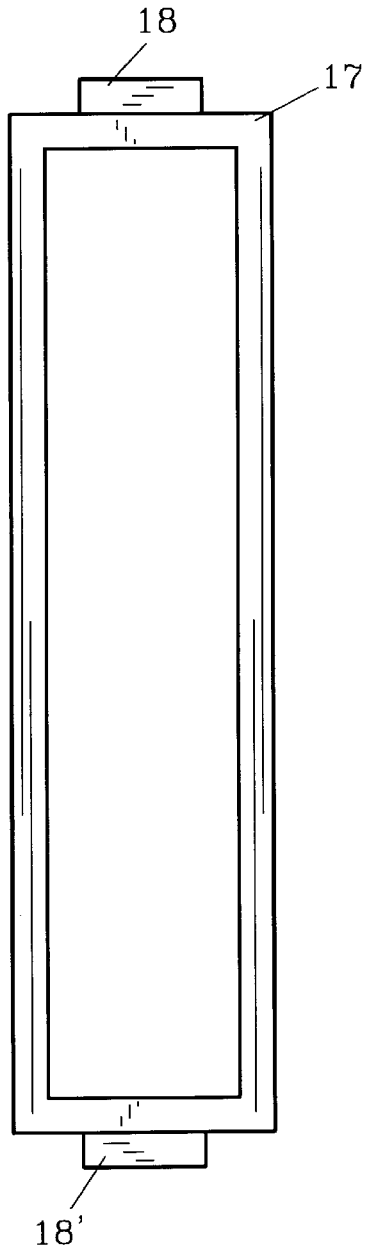
FIG. 8 depicts a front elevational view of the inner frame section.
Figure 9:
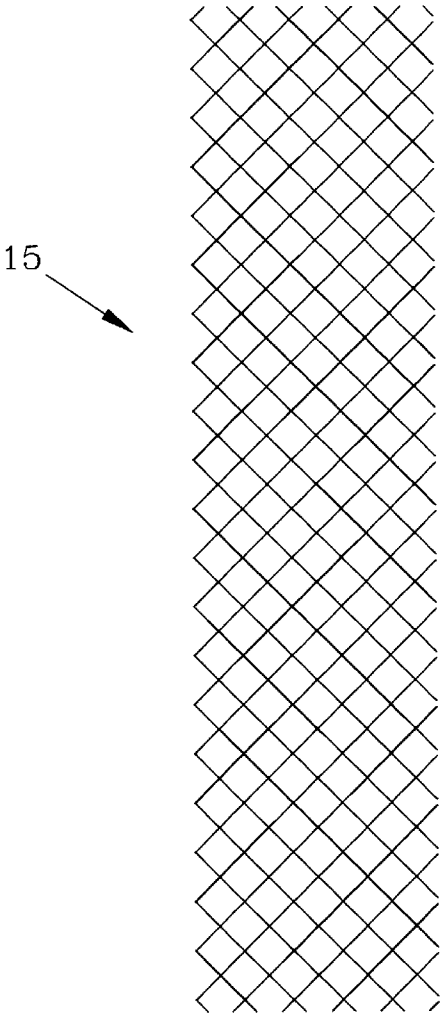
FIG. 9 demonstrates a front elevational view of the porous barrier as removed from the frame sections.
Figure 4:
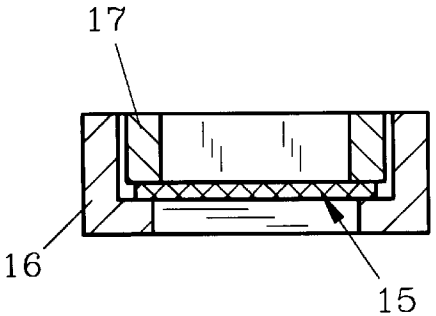
FIG. 4 depicts a cross-sectional view of the screen device along lines 4—4 of FIG. 3.
Figure 7:
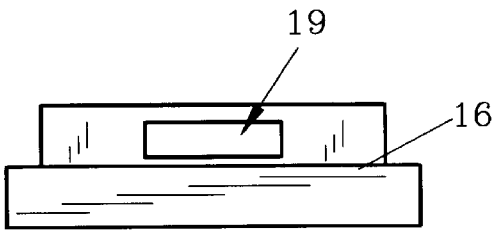
FIG. 7 provides a top plan view of the outer frame member as shown along lines 7—7 of FIG. 6.

In FIGS. 3 and 4, screen device 10 includes a porous barrier 15 as seen in FIG. 9 which may be preferably formed from a standard polymeric screen material as used for conventional window screens. Porous barrier 15 is contained and securely held in place by outer frame section 16 and inner frame section 17 (FIG. 8) which are formed from a polymeric material such as polyvinyl chloride, polyester, nylon or the like which is flexible. Inner frame section 17 is thus joined to outer frame section 16 by the use of tabs 18, 18' which pass through slots 19, 19' of outer frame section 16 as in FIGS. 3, 5, and 7. This assembly allows porous barrier 15 to be easily removed and cleaned as necessary.

Figure 2:
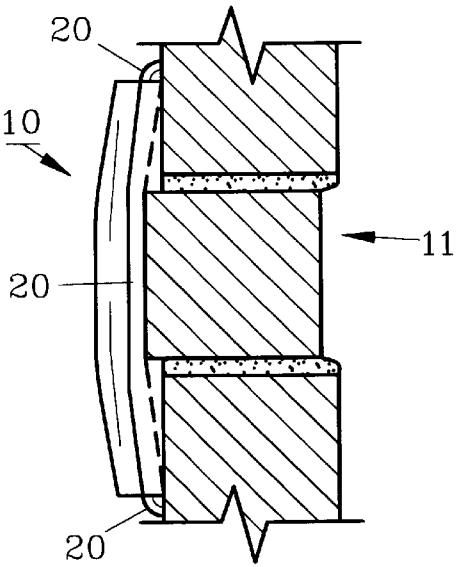
FIG. 2 shows a cross-sectional view of the foundation wall and screen device along lines 2—2 of FIG. 1 with a sealant added.

Many foundation walls formed from concrete with brick or stone have somewhat uneven surfaces as seen in FIG. 2. In order to insure that insects do not enter weep holes 13 even with screen device 10 in place, a durable adhesive such as a conventional silicone caulk or sealant 20 is preferred for use around the outer edges of frame section 16. As earlier explained, outer frame section 16 and inner frame section 17 are formed from flexible polymeric materials and can be bent and distorted as needed to carefully profile the outer foundation wall area around weep holes 13. Thus by bending screen device 10 and sealing it with silicone sealant 20, an insect-proof weep hole is provided which will prevent insect damage to the building while allowing weep holes 13 to release moisture as originally intended. Also inner frame section 17 can be easily removed, exposing porous barrier 15 for exchange or removal for cleaning purposes.

Figure 5:
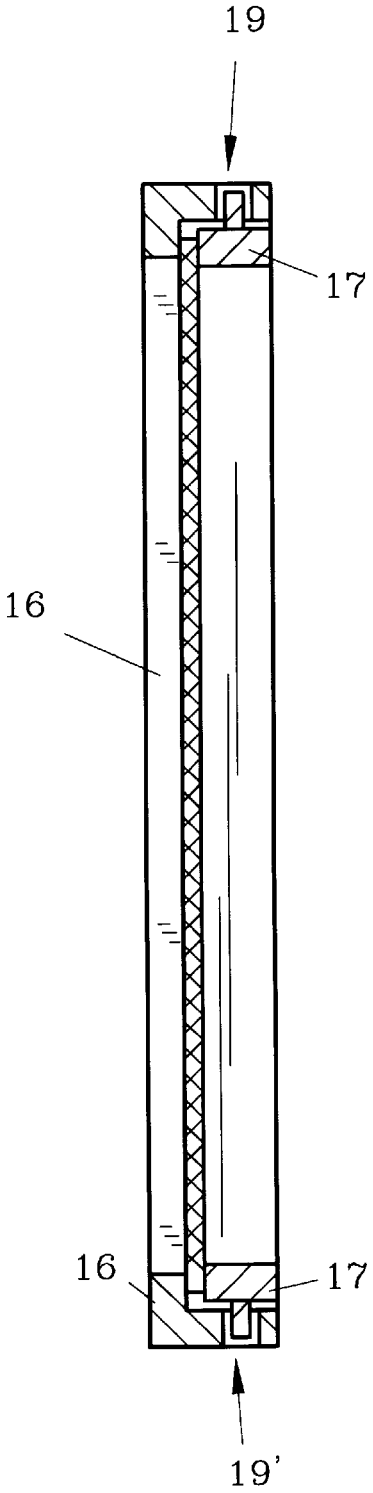
FIG. 5 pictures a cross-sectional view of the screen device along lines 5—5 of FIG. 3.
Figure 10:
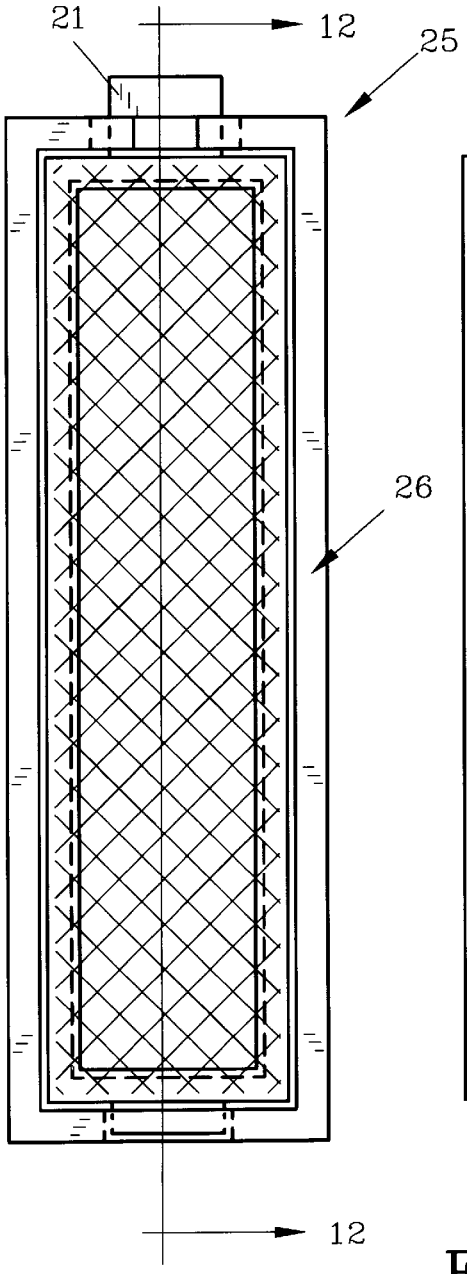
FIG. 10 features a rear elevational view of a second embodiment of the weep hole screen device.
Figure 11:
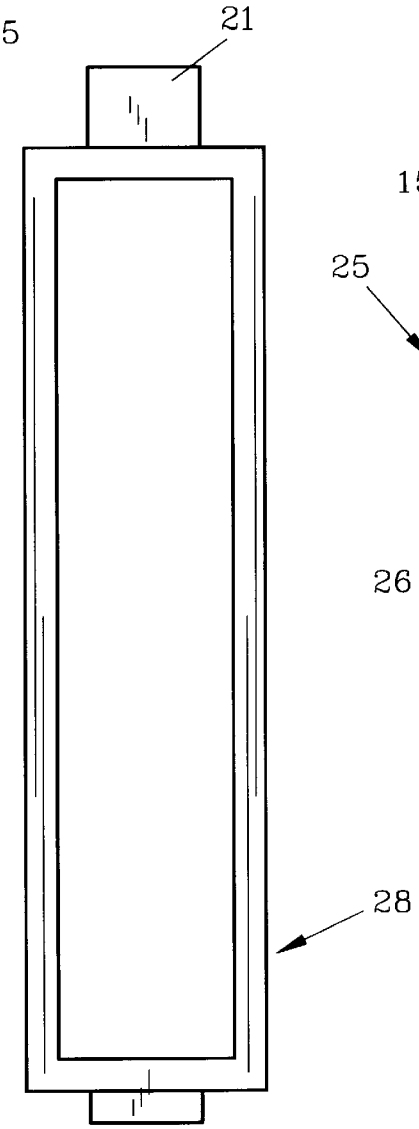
FIG. 11 shows a front elevational view of the inner frame section of the screen device as used in FIG. 10.
Figure 12:
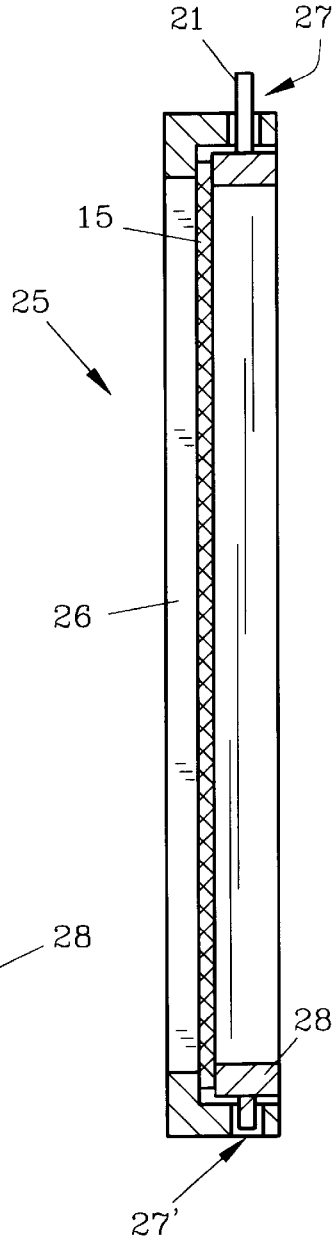
FIG. 12 demonstrates a cross-sectional view of FIG. 10 along lines 12—12.
Figure 13:
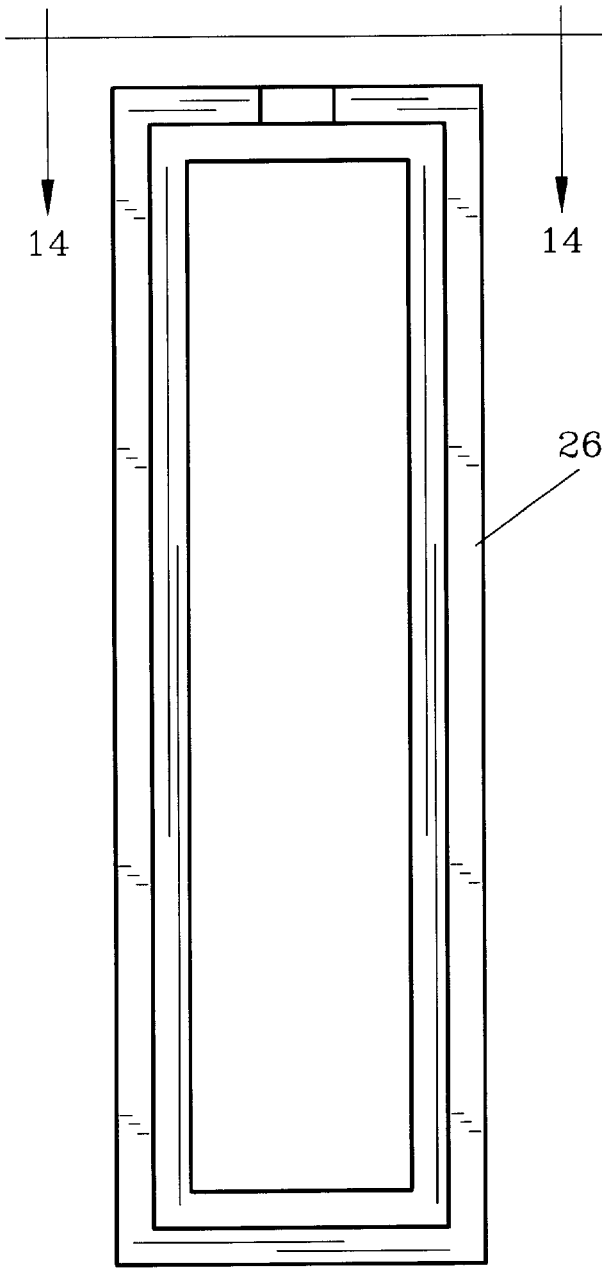
FIG. 13 pictures a front elevational view of the second embodiment of the outer frame section as shown in FIG. 10 with the porous barrier and inner frame section removed.
Figure 14:
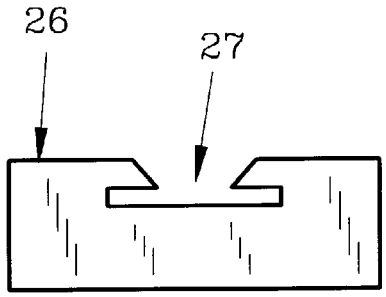
FIG. 14 features a top plan view of the outer frame section as seen along lines 14—14 of FIG. 13.

As an alternative embodiment, weep hole screen device 25 is shown in FIG. 10 having a long upper tab 21 protruding therethrough. Upper tab 21 can be turned or twisted for positioning within top slot 27 of outer frame section 26 as shown in FIG. 14. Bottom slot 27' (FIG. 12) as the same as bottom slot 19' as seen in FIGS. 3, 5, and 6 of screen device 10. Outer frame section 26 (FIGS. 10, 12 and 13) is identical in all respects to outer frame section 16 as shown in FIG. 6 except that slot 27 (FIG. 14) has wide and narrow portions thus, tab 21 (FIG. 11) must be twisted and as it passes through the narrow portion of opening 27 and upon release returns to its normal lateral position as shown in FIG. 12 thus preventing tab 21 from inadvertently slipping from opening 27 during normal use. As earlier described inner frame section 28 like outer frame section 26 is formed from a flexible polymeric material.

The illustrations and examples provided herein are for explanatory purposes and are not intended to limit the scope of the appended claims.

I claim:

1. A device to prevent animals from entering a weep hole comprising: a frame, said frame comprising an outer section and an inner section, and a porous barrier, said porous barrier contained between said inner and outer frame sections.

2. The device as claimed in claim 1 wherein said frame is formed from a polymeric material.

3. The device as claimed in claim 1 wherein said porous barrier comprises a screen.

4. The device as claimed in claim 3 wherein said screen is polymeric.

5. The device as claimed in claim 1 wherein said porous barrier is formed from a polymeric material.

6. A method of preventing animals from entering a weep hole of a building wall comprising the steps of:

(a) placing a porous barrier in a frame, (b) conforming the frame to the building wall to cover the weep hole, and (c) sealing the frame to the building wall.

7. The method of claim 6 wherein sealing the frame to the building wall comprises the step of:

sealing the frame to the building wall with a silicone sealant.

8. A method of preventing animals from entering a weep hole of a building wall comprising the steps of:

(a) positioning a porous barrier between an inner section and outer section of a frame;

(b) covering the weep hole with the frame; and (c) conforming the frame to the building wall.

9. The method of claim 8 further comprising the step of sealing the frame to the building wall with a sealant.

* * * * *